US011018463B2

(12) United States Patent
Watkins et al.

(10) Patent No.: US 11,018,463 B2
(45) Date of Patent: May 25, 2021

(54) COAXIAL CABLE CONNECTOR WITH INTEGRATED GROUNDING MEMBER

(71) Applicant: PPC Broadband, Inc., East Syracuse, NY (US)

(72) Inventors: Harold Watkins, Chittenango, NY (US); Richard Maroney, Alexandria, VA (US); Steve Stankovski, Clay, NY (US)

(73) Assignee: PPC BROADBAND, INC., East Syracuse, NY (US)

( * ) Notice: Subject to any disclaimer, the term of this patent is extended or adjusted under 35 U.S.C. 154(b) by 0 days.

(21) Appl. No.: 16/701,146

(22) Filed: Dec. 2, 2019

(65) Prior Publication Data

US 2020/0185868 A1 Jun. 11, 2020

Related U.S. Application Data

(60) Provisional application No. 62/773,788, filed on Nov. 30, 2018.

(51) Int. Cl.

| | |
|---|---|
| ***H01R 24/40*** | (2011.01) |
| ***H01R 13/622*** | (2006.01) |
| ***H01R 9/05*** | (2006.01) |
| *H01R 103/00* | (2006.01) |

(52) U.S. Cl.

CPC ..... *H01R 24/40* (2013.01); *H01R 9/0524* (2013.01); *H01R 13/622* (2013.01); *H01R 2103/00* (2013.01)

(58) Field of Classification Search

CPC ..... H01R 9/05; H01R 9/0524; H01R 9/0518; H01R 24/38; H01R 24/40; H01R 13/59; H01R 13/622

USPC ..... 439/578, 583–585

See application file for complete search history.

(56) References Cited

U.S. PATENT DOCUMENTS

| | | | | |
|---|---|---|---|---|
| 5,474,478 | A * | 12/1995 | Ballog | H01R 9/0521 439/578 |
| 5,766,037 | A | 6/1998 | Nelson | |
| 6,692,286 | B1 * | 2/2004 | De Cet | H01R 13/6277 439/350 |
| 7,635,283 | B1 | 12/2009 | Islam | |
| 7,806,714 | B2 * | 10/2010 | Williams | H01R 13/639 439/352 |
| 7,892,004 | B2 * | 2/2011 | Hertzler | H01R 13/6277 439/312 |
| 8,562,366 | B2 * | 10/2013 | Purdy | H01R 13/6592 439/322 |

(Continued)

OTHER PUBLICATIONS

Search Report dated Feb. 18, 2020 in corresponding International Application No. PCT/US19/64079, 2 pages.

(Continued)

*Primary Examiner* — Hien D Vu

(74) *Attorney, Agent, or Firm* — MH2 Technology Law Group LLP

(57) ABSTRACT

A coaxial cable connector includes a nut; and a connector body coupled with the nut, the connector body including a plurality of inner fingers 122 separated from each other by a plurality of gaps 124, wherein the inner fingers 122 extend from a forward end of the connector body 116 in a forward direction and biased radially outwardly to provide sufficient electrical contact with the nut 112 when inserted within the end of the nut 112.

20 Claims, 7 Drawing Sheets

(56) References Cited

U.S. PATENT DOCUMENTS

| | | | | |
|---|---|---|---|---|
| 8,827,743 | B1 | 9/2014 | Maury | |
| 2005/0079761 | A1 | 4/2005 | Rodrigues | |
| 2007/0224880 | A1 | 9/2007 | Wlos et al. | |
| 2010/0190377 | A1 | 7/2010 | Islam | |
| 2010/0233901 | A1* | 9/2010 | Wild ..... | H01R 13/6277<br>439/578 |
| 2012/0225581 | A1 | 9/2012 | Amidon et al. | |

OTHER PUBLICATIONS

Written Opinion dated Feb. 18, 2020 in corresponding International Application No. PCT/US19/64079, 3 pages.

* cited by examiner

COAXIAL CABLE CONNECTOR WITH INTEGRATED GROUNDING MEMBER

CROSS-REFERENCE TO RELATED APPLICATION

This nonprovisional application claims the benefit of U.S. Provisional Application No. 62/773,788, filed Nov. 30, 2018, the content of which is incorporated herein by reference in its entirety.

TECHNICAL FIELD

The present disclosure relates to connectors for coaxial cables.

BACKGROUND

A coaxial cable may be connected to another coaxial cable or to a radio frequency (RF) device using a coaxial cable connector. Coaxial cable connectors may be securely crimped to coaxial cables to which they are attached. The crimp must at least mechanically secure the connector to the cable, and it is also desirable for the crimp to block out moisture. Preparation of the connector/cable typically requires the use of several specialized tools including a stripping tool and a compression tool. The stripping tool removes a portion of the compliant outer jacket to expose an outer grounding conductor, which may be a braided conductor, and further removes an insulation layer to expose a signal-carrying inner conductor of the cable. The compression tool, on the other hand, inserts a grounding/retention post into the prepared end of the cable to effect an electrical and mechanical connection between the grounding conductor of the cable and an outer body, or housing, of the cable connector.

The step of compressing/inserting the grounding/retention post into the prepared end of the coaxial cable also requires a holding fixture to align the prepared end of the cable while a driver inserts the grounding/retention post beneath the outer jacket of the cable. As such, the outer jacket may be compressed between the annular sleeve and a fixed-diameter outer housing of the cable connector. Compression of the outer jacket causes the annular sleeve to engage the braided conductor of the cable, thereby retaining the grounding/retention post of the connector to the coaxial cable.

Post-based crimping connectors have the disadvantages of being difficult to assemble and potentially damaging to the coaxial cable. On the other hand, current post-less designs have been introduced, but these post-less designs have the disadvantages of being expensive to manufacture and providing an inferior seal and coupling when certain forces are applied to the cable. There remains a need in the art for an improved coaxial cable connector.

SUMMARY

According to various aspects of the disclosure, a connector for a coaxial cable includes a coupler portion configured to engage an interface port, a housing portion having a forward end configured to be disposed at least partially within the coupler portion, and an outer conductor engager portion made of a conductive material disposed within the housing portion. The housing portion includes a rearward end configured to receive the coaxial cable, the housing portion is configured to move axially relative to a post that engages the outer conductor of the cable, and an interior surface of the housing portion is configured to compress an insert of the post when the housing portion is moved axially relative to the post such that the outer conductor is compressed radially inward against an exterior surface of the insert of the post.

In some embodiments, the outer conductor engager portion is configured to remain axially stationary relative to the coupler portion when the housing portion moves relative to the outer conductor engager portion.

In some embodiments, the housing portion includes a forward body portion configured to be received by a rearward end of the coupler portion, a rearward body portion coupled with the forward body portion, and a sleeve portion surrounding the rearward body portion. According to various aspects, the coupler portion is configured to rotate relative to the forward body portion, the rearward body portion and the sleeve portion are configured to slide axially relative to the forward body portion, and an interior surface of the rearward body portion is configured to compress the insert of the post when the housing portion is moved axially relative to the outer conductor engager portion such that an outer conductor of the coaxial cable is compressed radially inward against an exterior surface of the insert of the post.

According to various embodiments, the connector further includes a terminal pin configured to receive a center conductor of the coaxial cable, wherein the terminal pin is configured to extend through the coupler portion and to be connected to the interface port. In some aspects, the connector includes an isolator configured to electrically isolate the terminal pin from the coupler portion and/or an isolator configured to electrically isolate the center conductor from the outer conductor engager portion.

In some embodiments, the housing portion includes a nose cone, a body, and a sleeve, the sleeve surrounding the body, and the body and the sleeve being configured to slide axially relative to the nose cone.

BRIEF DESCRIPTION OF THE DRAWINGS

Features and advantages of the present disclosure are described in, and will be apparent from, the following description.

DETAILED DESCRIPTION

The coaxial cable connectors described in the present disclosure utilize a compression sleeve that may be used to compress the sheath of a coaxial cable to hold the coaxial cable in place with respect to the connector. The compression force acts to pinch the end of the coaxial cable that is inserted in the connector. The structure of the connector allows an installer to merely insert the cable into the connector and then further compress the compression sleeve of the connector to provide sufficient electrical continuity between the outer grounding conductor of the cable with the conductive housing of the connector.

Figure 1:
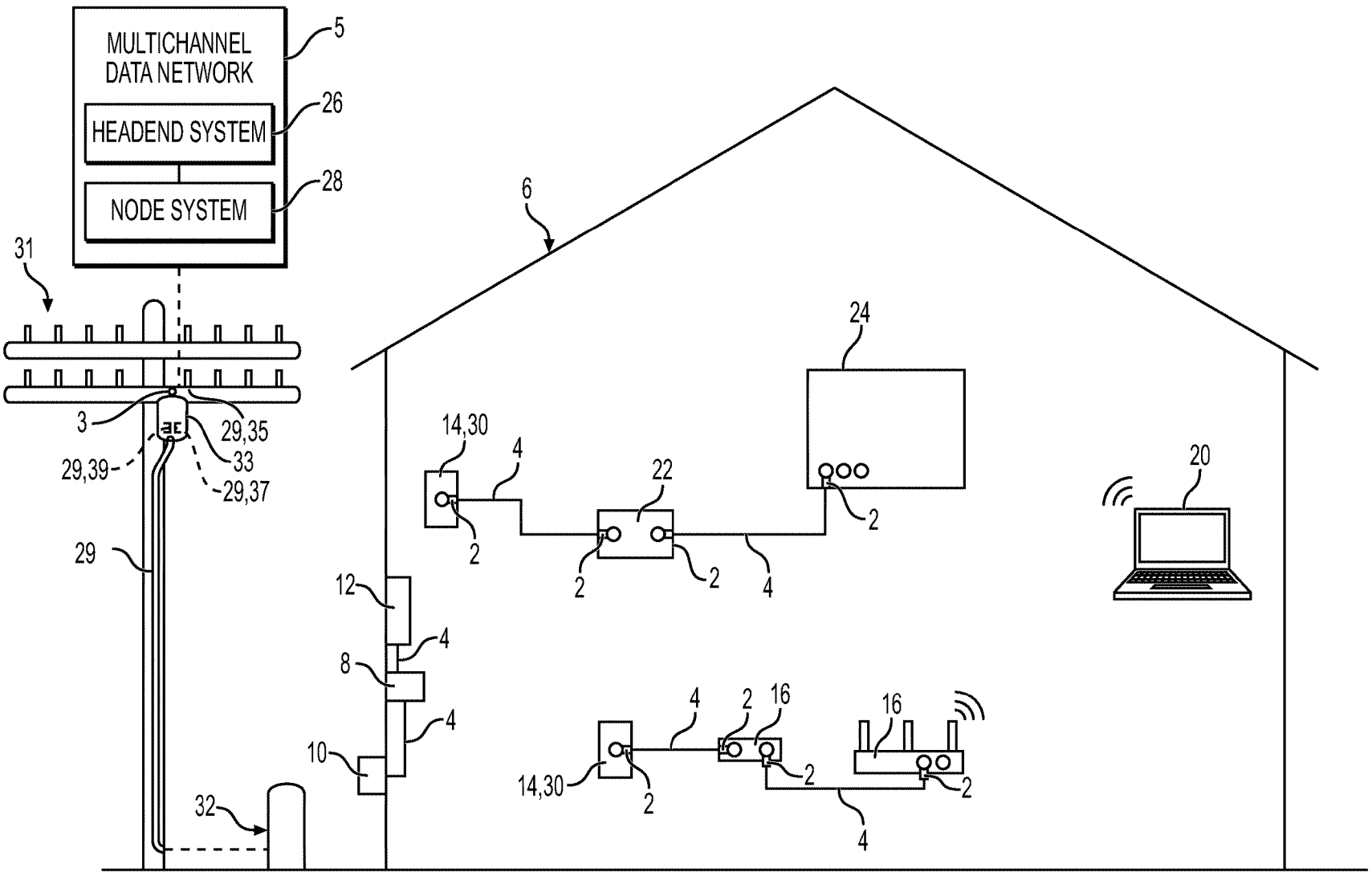
FIG. 1 is a schematic view of an exemplary network environment in accordance with various aspects of the disclosure.

Referring to FIG. 1, cable connectors 2 and 3 enable the exchange of data signals between a broadband network or multichannel data network 5, and various devices within a home, building, venue or other environment 6. For example, the environment's devices can include: (a) a point of entry ("PoE") filter 8 operatively coupled to an outdoor cable junction device 10; (b) one or more signal splitters within a service panel 12 which distributes the data service to interface ports 14 of various rooms or parts of the environment 6; (c) a modem 16 which modulates radio frequency ("RF") signals to generate digital signals to operate a wireless router 18; (d) an Internet accessible device, such as a mobile phone or computer 20, wirelessly coupled to the wireless router 18; and (e) a set-top unit 22 coupled to a television ("TV") 24. In one embodiment, the set-top unit 22, typically supplied by the data provider (e.g., the cable TV company), includes a TV tuner and a digital adapter for High Definition TV.

In some embodiments, the multichannel data network 5 includes a telecommunications, cable/satellite TV ("CATV") network operable to process and distribute different RF signals or channels of signals for a variety of services, including, but not limited to, TV, Internet and voice communication by phone. For TV service, each unique radio frequency or channel is associated with a different TV channel. The set-top unit 22 converts the radio frequencies to a digital format for delivery to the TV. Through the data network 5, the service provider can distribute a variety of types of data, including, but not limited to, TV programs including on-demand videos, Internet service including wireless or WiFi Internet service, voice data distributed through digital phone service or Voice Over Internet Protocol ("VoIP") phone service, Internet Protocol TV ("IPTV") data streams, multimedia content, audio data, music, radio and other types of data.

As described above, the data service provider uses coaxial cables 29 and 4 to distribute the data to the environment 6. The environment 6 has an array of coaxial cables 4 at different locations. The connectors 2 are attachable to the coaxial cables 4. The cables 4, through use of the connectors 2, are connectable to various communication interfaces within the environment 6, such as the female interface ports 14 illustrated in FIGS. 1-2. In the examples shown, female interface ports 14 are incorporated into: (a) a signal splitter within an outdoor cable service or distribution box 32 which distributes data service to multiple homes or environments 6 close to each other; (b) a signal splitter within the outdoor cable junction box or cable junction device 10 which distributes the data service into the environment 6; (c) the set-top unit 22; (d) the TV 24; (e) wall-mounted jacks, such as a wall plate; and (f) the router 18.

Figure 2:
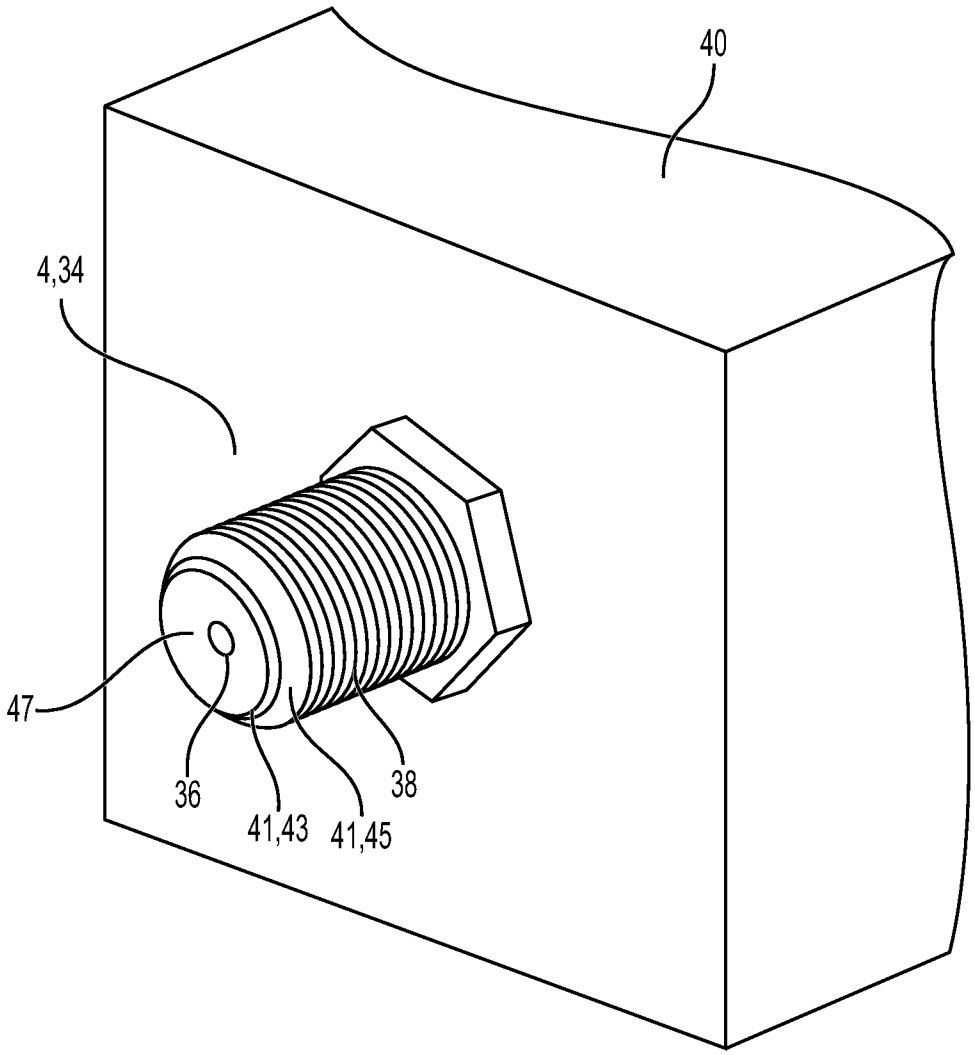
FIG. 2 is a perspective view of an exemplary interface port in accordance with various aspects of the disclosure.

In one embodiment, each of the female interface ports 14 includes a stud or jack, such as the cylindrical stud 34 illustrated in FIG. 2. The stud 34 has: (a) an inner, cylindrical wall 36 defining a central hole configured to receive an electrical contact, wire, pin, conductor (not shown) positioned within the central hole; (b) a conductive, threaded outer surface 38; (c) a conical conductive region 41 having conductive contact sections 43 and 45; and (d) a dielectric or insulation material 47.

In some embodiments, stud 34 is shaped and sized to be compatible with the F-type coaxial connection standard. It should be understood that, depending upon the embodiment, stud 34 could have a smooth outer surface. The stud 34 can be operatively coupled to, or incorporated into, a device 40 which can include, for example, a cable splitter of a distribution box 32, outdoor cable junction box 10 or service panel 12; a set-top unit 22; a TV 24; a wall plate; a modem 16; a router 18; or the junction device 33.

During installation, the installer couples a cable 4 to an interface port 14 by screwing or pushing the connector 2 onto the female interface port 34. Once installed, the connector 2 receives the female interface port 34. The connector 2 establishes an electrical connection between the cable 4 and the electrical contact of the female interface port 34.

Figure 4:
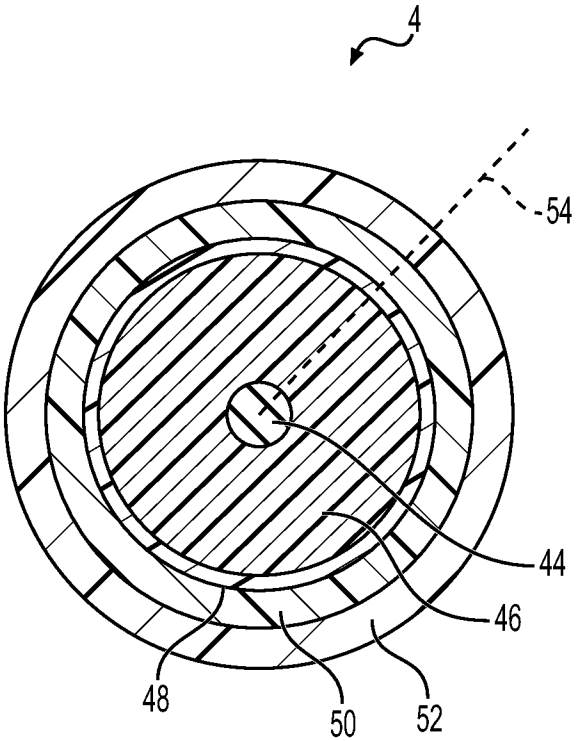
FIG. 4 is a cross-sectional view of the exemplary coaxial cable of FIG. 3.
Figure 3:
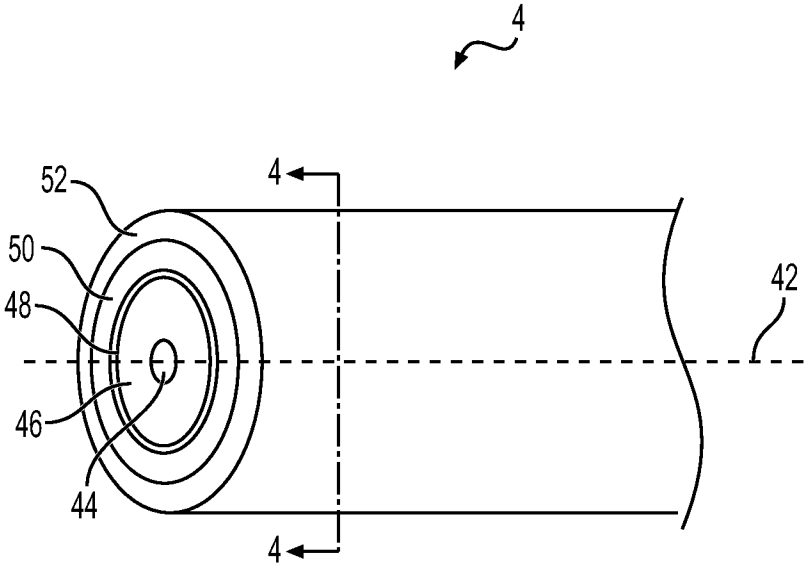
FIG. 3 is a perspective view of an exemplary coaxial cable in accordance with various aspects of the disclosure.
Figure 5:
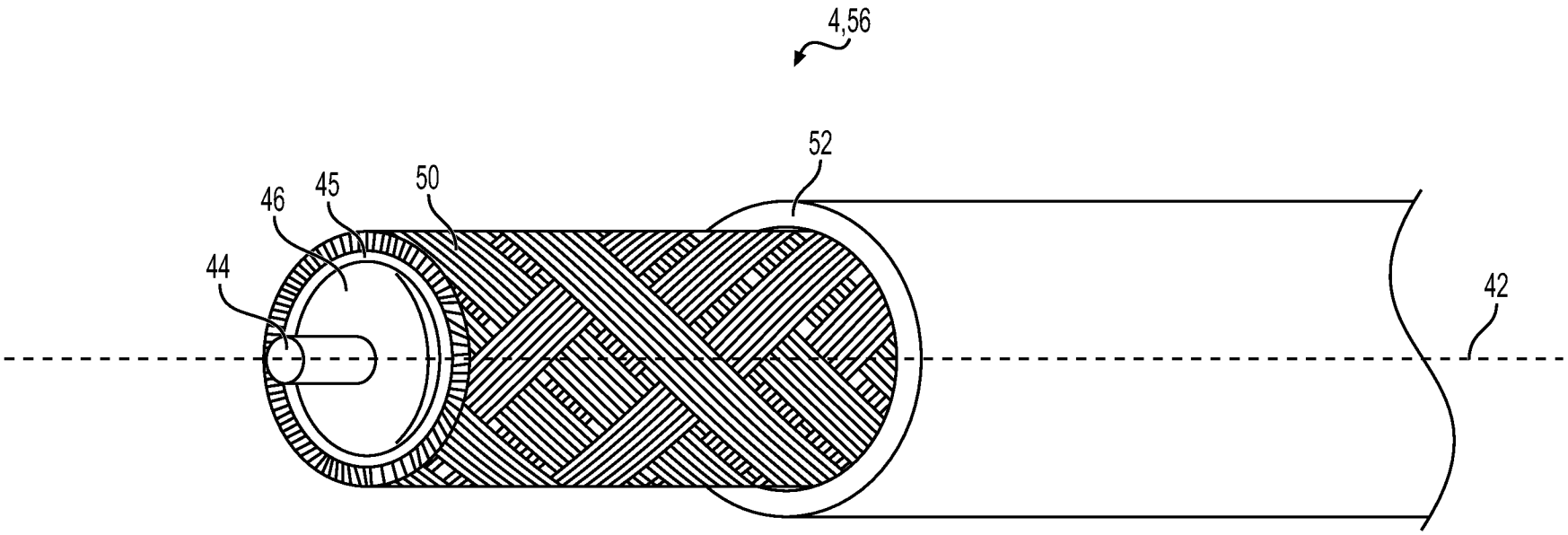
FIG. 5 is a perspective view of an exemplary prepared end of the exemplary coaxial cable of FIG. 3.

Referring to FIGS. 3-5, the coaxial cable 4 extends along a cable axis or a longitudinal axis 42. In one embodiment, the cable 4 includes: (a) an elongated center conductor or inner conductor 44; (b) an elongated insulator 46 coaxially surrounding the inner conductor 44; (c) an elongated, conductive foil layer 48 coaxially surrounding the insulator 46; (d) an elongated outer conductor 50 coaxially surrounding the foil layer 48; and (e) an elongated sheath, sleeve or jacket 52 coaxially surrounding the outer conductor 50.

The inner conductor 44 is operable to carry data signals to and from the data network 5. Depending upon the embodiment, the inner conductor 44 can be a strand, a solid wire or a hollow, tubular wire. The inner conductor 44 is, in one embodiment, constructed of a conductive material suitable for data transmission, such as a metal or alloy including copper, including, but not limited, to copper-clad aluminum ("CCA"), copper-clad steel ("CCS") or silver-coated copper-clad steel ("SCCCS").

The insulator 46, in some embodiments, is a dielectric having a tubular shape. In one embodiment, the insulator 46 is radially compressible along a radius or radial line 54, and the insulator 46 is axially flexible along the longitudinal axis 42. Depending upon the embodiment, the insulator 46 can be a suitable polymer, such as polyethylene ("PE") or a fluoropolymer, in solid or foam form.

In the embodiment illustrated in FIG. 3, the outer conductor 50 includes a conductive RF shield or electromagnetic radiation shield. In such embodiment, the outer conductor 50 includes a conductive screen, mesh or braid or otherwise has a perforated configuration defining a matrix, grid or array of openings. In one such embodiment, the braided outer conductor 50 has an aluminum material or a suitable combination of aluminum and polyester. Depending upon the embodiment, cable 4 can include multiple, overlapping layers of braided outer conductors 50, such as a dual-shield configuration, tri-shield configuration or quad-shield configuration.

In one embodiment, the connector 2 electrically grounds the outer conductor 50 of the coaxial cable 4. The conductive foil layer 48, in one embodiment, is an additional, tubular conductor which provides additional shielding of the magnetic fields. In one embodiment, the jacket 52 has a protective characteristic, guarding the cable's internal components from damage. The jacket 52 also has an electrical insulation characteristic.

Referring to FIG. 5, in one embodiment, an installer or preparer prepares a terminal end 56 of the cable 4 so that it can be mechanically connected to the connector 2. To do so, the preparer removes or strips away differently sized portions of the jacket 52, outer conductor 50, foil layer 48 and insulator 46 so as to expose the side walls of the jacket 52, outer conductor 50, foil layer 48 and insulator 46 in a stepped or staggered fashion. In the example shown in FIG. 5, the prepared end 56 has a two step-shaped configuration. In some embodiments, the prepared terminal end 56 has a three step-shaped configuration (not shown), where the insulator 46 extends beyond an end of the foil 48 and outer conductor 50. At this point, the cable 4 is ready to be connected to the connector 2.

Depending upon the embodiment, the components of the cable 4 can be constructed of various materials which have some degree of elasticity or flexibility. The elasticity enables the cable 4 to flex or bend in accordance with broadband communications standards, installation methods or installation equipment. Also, the radial thicknesses of the cable 4, the inner conductor 44, the insulator 46, the conductive foil layer 48, the outer conductor 50 and the jacket 52 can vary based upon parameters corresponding to broadband communication standards or installation equipment.

Figure 6:
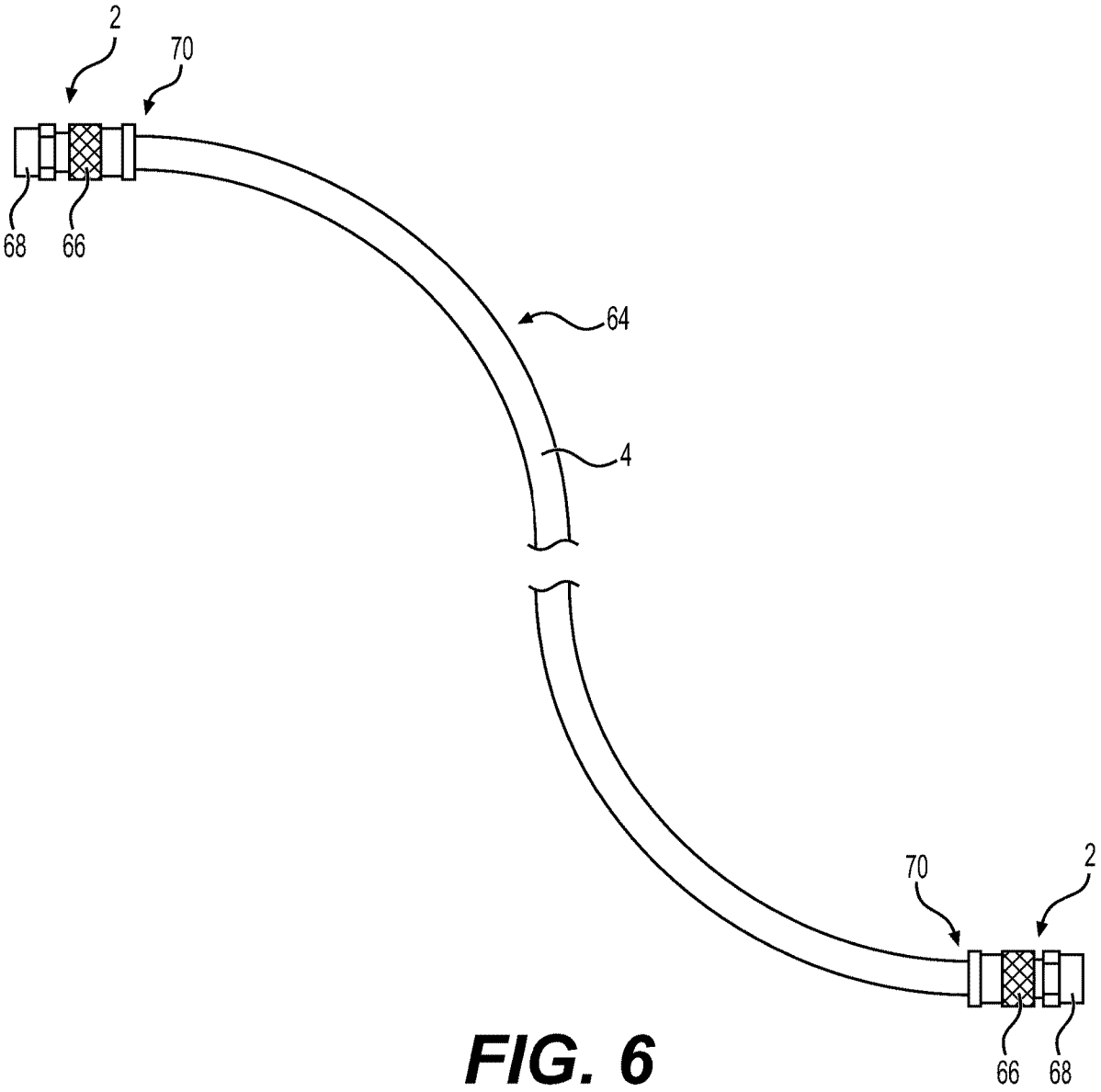
FIG. 6 is a side view of one embodiment of a coaxial cable jumper or cable assembly which is configured to be operatively coupled to the multichannel data network shown in FIG. 1.

In one embodiment illustrated in FIG. 6, a cable jumper or cable assembly 64 includes a combination of the connector 2 and the cable 4 attached to the connector 2. In this embodiment, the connector 2 includes a connector body or connector housing 66 and a fastener or coupler 68, such as a threaded nut, which is rotatably coupled to the connector housing 66. The cable assembly 64 has, in one embodiment, connectors 2 on both of its ends 70. In some embodiments, the cable assembly 64 may have a connector 2 on one end and either no connector or a different connector at the other end. Preassembled cable jumpers or cable assemblies 64 can facilitate the installation of cables 4 for various purposes.

The coaxial cable connector 2 of the present disclosure provides a reliable electrical ground, a secure axial connection, and a watertight seal across leakage-prone interfaces of the coaxial cable connector 2.

The coaxial cable connector 2 comprises a post for engaging the outer conductor 50, a housing or body, and a coupler or threaded nut to engage the interface port 34. The post includes an aperture for receiving the insulator 46 and, in some embodiments, portions of the foil layer 48 and/or outer braided conductor 50 of a prepared coaxial cable, i.e., an end which has been stripped of its outer jacket similar to that shown in FIG. 5. The post may also include an insert that projects from a body portion of the post and is inserted axially underneath the foil layer 48 and/or outer conductor 50 of the coaxial cable 4.

Figure 7:
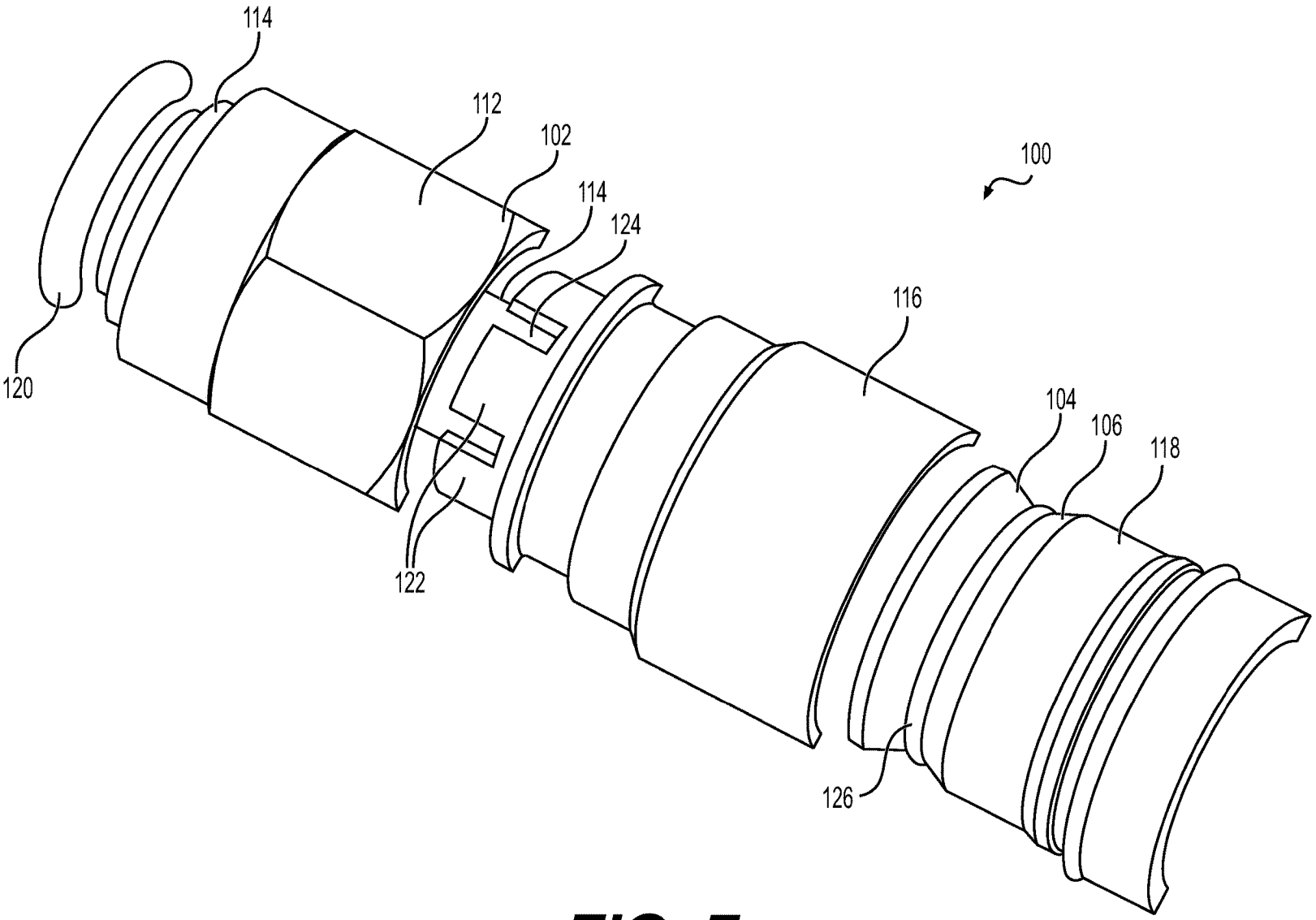
FIG. 7 is a perspective view of an exemplary coaxial cable connector in accordance with various aspects of the disclosure.
Figure 8:
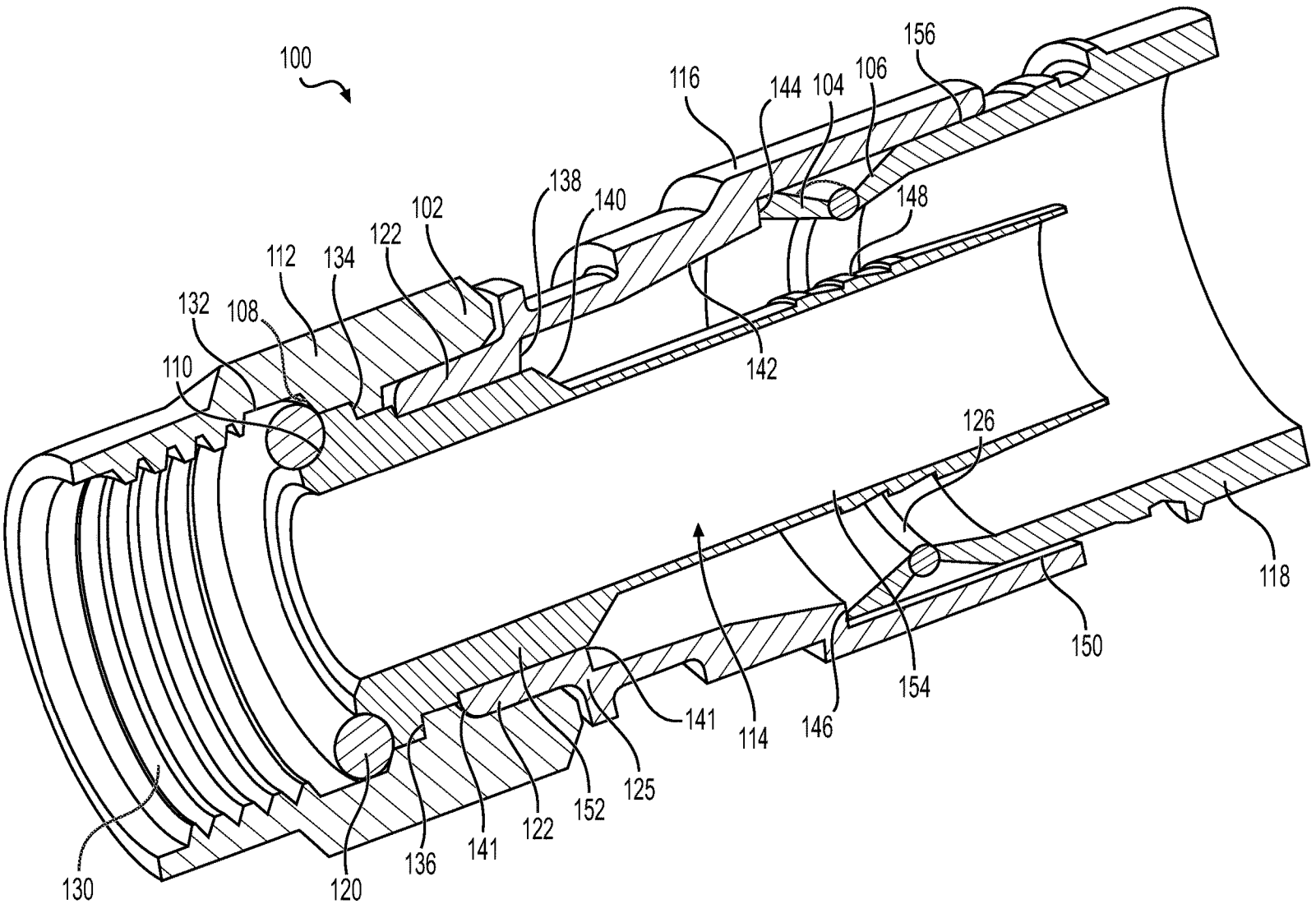
FIG. 8 is a cross-sectional perspective view of the exemplary coaxial cable connector of FIG. 7 in accordance with various aspects of the disclosure.

According to the disclosure, the aforementioned connectors 2 may be configured as a coaxial cable connector 100 as illustrated in FIGS. 7 and 8.

FIG. 7 illustrates an exploded view of an embodiment of a coaxial cable connector 100 according to the teachings of the present disclosure. A cross-sectional perspective view of the coaxial cable connector 100 is shown in FIG. 8, which shows the coaxial cable connector 100 in its assembled form.

Generally, the coaxial cable connector 100 comprises a nut 112 (or coupler), a post (or outer conductor engager) 114, a connector body 116, a compression sleeve 118, and an O-ring 120. The nut 112, post 114, and connector body 116 may comprise metal, plated plastic, or other electrically conductive material for providing electrical continuity with the outer grounding conductor 50 of the coaxial cable 4 and for maintaining a ground potential. The sleeve 118 may comprise plastic or other suitable material.

As shown in FIG. 7, the connector body 116 includes a plurality of inner fingers 122 separated from each other by a plurality of gaps 124. The inner fingers 122 may be referred to as integrated continuity members for providing electrical conductivity from the connector body 116 to the nut 112. The inner fingers 122 extend from a forward end of the connector body 116 in a forward direction (corresponding to a leftward direction as shown in FIGS. 7-8). The inner fingers 122 may be biased radially outwardly to provide sufficient electrical contact with the nut 112 when inserted within the end of the nut 112. In the assembled state of the connector 100 as shown in FIG. 8, the inner fingers 122 are configured to extend between a rear portion 102 of the nut 112 and a front portion (e.g., body portion 152) of the post 114.

The compression sleeve 118 may include plastic or other material that may be suitably flexible. An O-ring 126 is inserted within a trench of the compression sleeve 118, the trench being formed at an intersection between two reclined surfaces 104, 106. The reclined surfaces 104, 106 may have a thickness that is sufficiently thin enough to allow the reclined surfaces 104, 106 to bend as needed and may be considerably thinner than other portions of the sleeve 118. When a force is applied to the compression sleeve 118 in an axial direction, the O-ring 126 allows the reclined surfaces 104, 106 of the compression sleeve 118 to be compressed farther. Also, the O-ring 126 may be configured over the sleeve 118 to create a robust seal.

In FIG. 8, a cross-sectional view of the connector 100 is shown in its assembled state. When assembled, the inner fingers 122 of the connector body 116 are maintained between the rear portion 102 of the nut 112 and the body portion 152 of the post 114. The O-ring 120 is inserted within a notch 132 of the nut 112 and provides a seal for protecting the conductors of the coaxial cable 4 from moisture or other environmental elements.

The O-ring 120 may also apply a slight force on a front surface 110 of the post 114 so that a rearward facing shoulder 134 of the post 114 maintains contact with a front edge of an inner ring 136 of the nut 112. However, the force does not prevent the nut 112 from rotating with respect to the post 114, thereby allowing the nut 112 to be screwed onto a corresponding port as needed. An inner surface of the nut 112 includes threads 130 allowing the nut 112 to be screwed onto the corresponding port. For example, the threads 130 of the nut 112 may be screwed onto the outer threaded surface 38 of the female interface port 34 shown in FIG. 2.

The post 114 includes a flange 141 that extends radially outward past an outer surface of the body portion 152 of the post 114. The flange 141 is configured to engage heels of the inner fingers 112 hold the inner fingers 122 of the connector body 116 together with the nut 112 and post 114 when the connector 100 is assembled. The flange 141 contacts the heel portion of the connector body 116 that is formed of the inner fingers 122 and a radial portion 125 of the connector body 116. With the heel contacting the body portion 152 of the post 114 and the inner fingers 122 biased outward to provide contact with the rear portion 102 of the nut, electrical continuity can be maintained between the post 114 and the nut 112 via the inner fingers 122.

The nut 112 includes a notch 132 configured to accommodate the O-ring 120. The notch 132 is configured so as to allow the O-ring 120 to act as a seal between the nut 112 and the post 114. The post 114 includes a rearward facing shoulder 134 that is configured to contact a front edge of an inner ring 136 of the nut 112 when the coaxial cable connector 100 is in its assembled state. A rear portion of the O-ring 120 may be pressed against a forward facing surface 108 of the notch 132 of the nut 112 and a front surface 110 of the post 114 when the O-ring 120 is inserted within the walls of the notch 132.

The radial portion 125 of the connector body 116 includes an inward stop 138 formed on an opposite side of the radial portion 125 from the inner fingers 122. The inward stop 138, along with an outward stop 140 of the post 114, are configured to form an abutment for the foil layer 48 and/or outer conductor 50, which are grounded conductors, of the cable 4. Thus, when the cable 4 is prepared as shown in FIG. 5 or in a similar manner, the foil layer 48 and/or outer conductor 50 make physical and electrical contact with an insert portion 154 of the post 114 and portions of the connector body 116.

The insert portion 154 of the post 114 may be inserted underneath the foil layer 48 to make sufficient physical and electrical contact with the foil layer 48. Alternatively, the insert portion 154 may be inserted between the foil layer 48 and outer conductor 50 to make sufficient physical and electrical contact with the outer conductor 50. In some embodiments, the insert portion of the post 114 may include ribs 148 that are configured to resist movement of a cable 4 that has been inserted in the space between an inclined surface 142 on an inner surface of the connector body 116 and the insert portion 154 of the post 114.

In addition, the compression sleeve 118 includes a protrusion 150 that extends radially outward with respect to a main body portion of the compression sleeve 118. In an installed configuration in which the connector 100 is attached to the end of the prepared cable 4, the protrusion 150 of the compression sleeve 118 is configured to engage a forward-facing step 156 formed near a rear portion of the connector body 116. Engagement of the protrusion 150 with the step 156 holds the connector 100 in a completed state (e.g., FIG. 8).

However, before the protrusion 150 is engaged with the step 156, the inclined portions 104, 106 may be arranged is a slightly less inclined state and positioned inside an inner surface of the connector body 116. By sliding the compression sleeve 118 in a forward direction, a forward end 146 of the compression sleeve 118 contacts an inner step 144 of the connector body 116. When the compression sleeve 118 is forced farther in the forward direction after contact is made with the inner stop 144, the compression force of the O-ring 126 can be used to more easily bend the inclined portions 104, 106 to more greatly inclined positions with respect to the axis of the connector 100. Also, the inclined portions 104, 106 nearest to the O-ring 126 will press against an inserted cable 4, thereby holding the cable 4 in its inserted state. Also, the ribs 148 assist with maintaining the cable 4 in its inserted state without backing out.

While the compression sleeve 118 is moved in the forward direction such that the inclined portions 104, 106 compress the outer surfaces of the inserted cable 4, the protrusion 150 slides within the end of the connector body 116 and engages the step 156. This may be possible after a slight bending of the compression sleeve 118 at the O-ring 126, to hold the compression sleeve 118 in the compressed state.

The following method may be used for assembling the parts of the connector 100 shown in FIG. 7 to form a completed connector 100, as shown in FIG. 8. The inner fingers 122 of the connector body 116 are inserted under the rear portion 102 of the nut 112. The insert portion 154 of the post 114 is inserted through a front opening of the nut 112 until the flange 141 of the post 114 snaps onto or is pressed fitted onto the heel of the radial portion 125 of the connector body 116. At this point, the rearward facing shoulder 134 of the post 114 may come in contact with the front edge of the inner ring 136 of the nut 112. Then, the O-ring 120 is inserted in the front opening of the nut 112 until it is positioned within the walls of the notch 132. Then, the compression sleeve 118 is inserted into the rear of the connector body 116 until the forward end 146 of the sleeve 118 contacts the inner stop 114 of the connector body 116.

Next, the coaxial cable 4, which has been prepared in such a way that the insulator 48 extends further forward than the sheath 52. For example, the coaxial cable 4 may be prepared in a way that is similar to the prepared cable shown in FIG. 5 and/or may be prepared with the foil layer 48 and outer conductor 50 extending the same length as the sheath 52. The prepared coaxial cable 4 is inserted into the rear of the sleeve 118 such that the center conductor 44 and insulator 46 of the cable 4 are fed through an aperture of the post 114. The coaxial cable 4 is pressed further in the forward direction such that the insert portion 154 of the post 114 is inserted under the foil layer 48 and/or outer conductor 50 of the cable 4. During this action, the outer conductor 50 and sheath 52 are separated from the center conductor 44 and insulator 46 of the cable 4 and fed in the space between the outer surface of the insert portion 154 of the post 114 and the gradual incline 142 of the inner surface of the connector body 116.

When the prepared cable is moved forward in this way, the forward end of the outer conductor and/or sheath 52 may reach the abutment formed by the inward stop 138 and the outward stop 140. In a next step, the compression sleeve 118 is moved in a forward direction to compress the thin inclined walls 104, 106 of the sleeve 118 in an inward direction to thereby compress the sheath 52 of the cable 4. The cable 4 may be held in place by this compression on the sheath 52. Also, the foil layer 48 and/or outer conductor 50 are held in place by the resistance offered by the edges of the ribs 148 to thereby prevent the cable 4 from backing out of the space. The compression sleeve 118 may be compressed until the protrusion 150 of the sleeve 118 is able to slide past the rearward end of the connector body 116 to engage with the step 156 of the connector body 116.

What is claimed is:

1. A coaxial cable electrical connector, comprising:

a nut having a threaded forward end and a rearward end;

a post coupled with the nut such that the nut is configured to rotate relative to the post;

a connector body coupled with the nut and the post, the connector body having a forward end and a rearward end in an axial direction; and a connection sleeve slidingly coupled with the connector body, wherein the connector body includes a plurality of axially extending fingers extending in a forward direction at the forward end of the connector body, the plurality of axially extending fingers being separated by gaps at the forward end of the connector body;

wherein the post includes a main body portion having a radially outward facing surface and a flange portion forward of the main body portion, the flange portion extending radially outward relative to the main body portion;

wherein the nut includes a main body portion having a radially inward facing surface and a lip portion forward of the main body portion of the nut, the lip portion extending radially inward relative to the main body portion of the nut;

the plurality of axially extending fingers are configured to physically and electrically contact the radially inward facing surface of the main body portion of the nut and the radially outward facing surface of the main body portion of the post;

wherein the plurality of axially extending fingers are configured to be biased radially outward by the radially outward facing surface of the main body portion of the post into contact with the radially inward facing surface of the main body portion of the nut;

wherein the post is configured to physically and electrically contact an outer conductor of a coaxial cable;

wherein the plurality of axially extending fingers are configured to provide an electrical grounding path between the post and the nut; and wherein the connector body is a single monolithic structure, and the plurality of axially extending fingers are a portion of the single monolithic structure.

2. The coaxial cable electrical connector of claim 1, wherein the compression sleeve is configured to be radially compressed onto a coaxial cable by sliding movement of the compression sleeve relative to the connector body.

3. The coaxial cable electrical connector of claim 1, wherein the flange portion includes a rearward facing surface configured to engage the plurality of axially extending fingers.

4. The coaxial cable electrical connector of claim 1, wherein the post includes a second flange portion forward of the flange portion, the second flange portion extending radially outward relative to the flange portion; and wherein the second flange portion includes a rearward facing surface configured to engage a forward facing surface of the lip portion of the nut.

5. A coaxial cable electrical connector, comprising:

a nut having a forward end and a rearward end;

a post coupled with the nut such that the nut is configured to rotate relative to the post; and a connector body coupled with the nut and the post, the connector body having a forward end and a rearward end in an axial direction, wherein the connector body includes a plurality of axially extending fingers extending in a forward direction at the forward end of the connector body, the plurality of axially extending fingers being separated by gaps at the forward end of the connector body;

wherein the plurality of axially extending fingers are configured to physically and electrically contact a radially inward facing surface of the nut and a radially outward facing surface of the post;

wherein the plurality of axially extending fingers are configured to be biased radially outward by the post into contact with the nut;

wherein the post is configured to physically and electrically contact an outer conductor of a coaxial cable; and wherein the plurality of axially extending fingers are configured to provide an electrical grounding path between the post and the nut.

6. The coaxial cable electrical connector of claim 5, further comprising a connection sleeve slidingly coupled with the connector body.

7. The coaxial cable electrical connector of claim 6, wherein the compression sleeve is configured to be radially compressed onto a coaxial cable by sliding movement of the compression sleeve relative to the connector body.

8. The coaxial cable electrical connector of claim 5, wherein the post includes a main body portion having the radially outward facing surface and a flange portion forward of the main body portion, the flange portion extending radially outward relative to the main body portion.

9. The coaxial cable electrical connector of claim 8, wherein the flange portion of the post includes a rearward facing surface configured to engage the plurality of axially extending fingers.

10. The coaxial cable electrical connector of claim 8, wherein the nut includes a main body portion having the radially inward facing surface and a lip portion forward of the main body portion of the nut, the lip portion extending radially inward relative to the main body portion of the nut.

11. The coaxial cable electrical connector of claim 10, wherein the post includes a second flange portion forward of the flange portion, the second flange portion extending radially outward relative to the flange portion; and wherein the second flange portion includes a rearward facing surface configured to engage a forward facing surface of the lip portion of the nut.

12. The coaxial cable electrical connector of claim 5, wherein the connector body is a single monolithic structure, and the plurality of axially extending fingers are a portion of the single monolithic structure.

13. A coaxial cable electrical connector, comprising:

a nut having a forward end and a rearward end;

a post rotating coupled relative to the nut; and a body coupled with the nut and the post, the body having a forward end and a rearward end in an axial direction, wherein the body includes a plurality of axially extending fingers at the forward end of the body;

wherein the plurality of axially extending fingers are configured to physically and electrically contact a radially inward facing surface of the nut and a radially outward facing surface of the post;

wherein the plurality of axially extending fingers are configured to be biased radially outward by the post into contact with the nut; and wherein the plurality of axially extending fingers are configured to provide an electrical grounding path between the post and the nut.

14. The coaxial cable electrical connector of claim 13, further comprising a connection sleeve slidingly coupled with the body.

15. The coaxial cable electrical connector of claim 14, wherein the compression sleeve is configured to be radially compressed onto a coaxial cable by sliding movement of the compression sleeve relative to the body.

16. The coaxial cable electrical connector of claim 13, wherein the post includes a main body portion having the radially outward facing surface and a flange portion forward of the main body portion, the flange portion extending radially outward relative to the main body portion.

17. The coaxial cable electrical connector of claim 16, wherein the flange portion of the post includes a rearward facing surface configured to engage the plurality of axially extending fingers.

18. The coaxial cable electrical connector of claim 16, wherein the nut includes a main body portion having the radially inward facing surface and a lip portion forward of the main body portion of the nut, the lip portion extending radially inward relative to the main body portion of the nut.

19. The coaxial cable electrical connector of claim 18, wherein the post includes a second flange portion forward of the flange portion, the second flange portion extending radially outward relative to the flange portion; and wherein the second flange portion includes a rearward facing surface configured to engage a forward facing surface of the lip portion of the nut.

20. The coaxial cable electrical connector of claim 13, wherein the body is a single monolithic structure, and the plurality of axially extending fingers are a portion of the single monolithic structure.

* * * * *